US008333627B2

(12) United States Patent
Novack, IV

(10) Patent No.: US 8,333,627 B2
(45) Date of Patent: Dec. 18, 2012

(54) UNDERWATER PROTECTIVE SYSTEM TO INHIBIT MARINE GROWTH

(76) Inventor: Michael J. Novack, IV, Port Hadlock, WA (US)

( * ) Notice: Subject to any disclaimer, the term of this patent is extended or adjusted under 35 U.S.C. 154(b) by 0 days.

(21) Appl. No.: 13/373,130

(22) Filed: Nov. 3, 2011

(65) Prior Publication Data

US 2012/0083175 A1 Apr. 5, 2012

Related U.S. Application Data

(63) Continuation of application No. 12/653,303, filed on Dec. 10, 2009, now Pat. No. 8,070,541, which is a continuation-in-part of application No. 12/587,027, filed on Sep. 30, 2009, now abandoned.

(51) Int. Cl.
*B63H 5/16* (2006.01)

(52) U.S. Cl. ..... 440/71; 114/361; 440/113

(58) Field of Classification Search ..... 114/222, 114/361; 440/71, 113; 416/146 R, 247 A, 416/247 R See application file for complete search history.

(56) References Cited

U.S. PATENT DOCUMENTS

| | | | | |
|---|---|---|---|---|
| 3,220,374 A | | 11/1965 | Sloan | 115/0.5 |
| 3,587,508 A | | 6/1971 | Pearce | 115/0.5 |
| 3,993,016 A | | 11/1976 | Pulaski | 116/2 |
| 4,328,761 A | * | 5/1982 | Dwyer | 114/222 |
| 4,826,461 A | | 5/1989 | Newman | 440/71 |
| 5,273,399 A | | 12/1993 | Ojeda | 416/146 R |
| 5,315,949 A | | 5/1994 | Bradley | 114/222 |
| 5,527,193 A | | 6/1996 | Doelcher | 440/69 |
| 5,964,174 A | | 10/1999 | Coggan | 114/222 |
| 6,152,064 A | | 11/2000 | Morton | 114/361 |
| 6,190,220 B1 | | 2/2001 | Borrelli | 440/78 |
| 6,916,217 B1 | | 7/2005 | Crepeau | 440/71 |
| 7,244,153 B2 | | 7/2007 | Lobrovich | 440/71 |
| 8,070,541 B2 | | 12/2011 | Novack | 114/361 |

* cited by examiner

*Primary Examiner* — Lars A Olson

(74) *Attorney, Agent, or Firm* — McDonnell Boehnen Hulbert & Berghoff LLP

(57) ABSTRACT

A protective system for underwater installation on the propeller inhibits marine growth from fouling the propeller. The system includes a flexible material sized and shaped so as to be capable of enclosing the propeller. A member such as a clamp or clip maintains the flexible material in a state enclosing the propeller. The system further includes a link (such as a piece of line) having one end attached to the member and/or the flexible material and a free second end. The link extends to a location proximate to the boat at or above the waterline of the boat wherein the link can be retrieved by a user. A tug on the link releases the flexible material from the propeller permitting the retrieval of the link, the member and the flexible material as a unit from the propeller without the aid of a diver.

21 Claims, 10 Drawing Sheets

UNDERWATER PROTECTIVE SYSTEM TO INHIBIT MARINE GROWTH

PRIORITY

This is a continuation of application Ser. No. 12/653,303 filed Dec. 10, 2009, now U.S. Pat. No. 8,070,541, which is a continuation-in-part of application Ser. No. 12/587,027 filed Sep. 30, 2009, now abandoned.

BACKGROUND OF THE INVENTION

A. Field This invention relates generally to marine equipment protective devices, and more particularly to a protective cover for propellers, transducers and other underwater components to protect against marine growth.

B. Description of Related Art Underwater components, particularly propellers and connected propeller shafts, transducers and the like, are susceptible to the development of marine growth when submerged in sea water. Such growth can include barnacles, sea grass, slime, etc. (collectively referred to as "marine growth"). Marine growth that attaches to propellers remains attached even when the propeller turns to propel the boat at typical cruising speeds. Marine growth can significantly reduce the efficiency of the boat's propulsion system. Accordingly, countermeasures to ameliorate marine growth attaching to propellers have been proposed.

These countermeasures can take a variety of forms. One is to hire a diver to scrub and clean the propeller at regular intervals, or in advance of a voyage. Another is to apply an antifouling paint to the propeller. The art has further developed a variety of protective devices that are designed to cover or protect marine propulsion apparatus while in the water. Such protective devices are described in the patent literature, and include Sloan, U.S. Pat. No. 3,220,374; Pearce, U.S. Pat. No. 3,587,508; Crepeau, U.S. Pat. No. 6,916,217; Morton, U.S. Pat. No. 6,152,064; and Borrelli, U.S. Pat. No. 6,190,220. Other patents of interest include Ojeda, U.S. Pat. No. 5,273,399; Newman, U.S. Pat. No. 4,826,461; Doelcher, U.S. Pat. No. 5,527,193 and Lobrovich, U.S. Pat. No. 7,244,154.

The present protective system of this disclosure is considered an improvement over the devices shown in these patents in that it is particularly suitable for propellers, transducers and other underwater components that are submerged substantially below the waterline (e.g., as in most medium and larger sailboats and power boats due the installation of inboard diesel or gas engines) yet can be readily released by the user/boat owner from above the water before their trip, without requiring a diver to release the protective system. The solutions proposed for example by the Sloan and Crepeau patents, cited above, are applicable to outdrives of inboard/outboard motors or outboards where the propeller itself is either able to be raised out of the water or otherwise is readily accessible. However, they are not suitable for propellers for inboard engines in which the propeller is typically several feet (or more) below the surface of the water. These designs, if adapted for such a propeller, would require a diver to disengage the cover from the propeller. None of the designs of the prior art address the problems of fouling of propellers of larger vessels in which the propeller is submerged substantially below the waterline, or provide an effective protective system for such a vessel which can be readily released by the user from a position on deck, without requiring the services of a diver.

SUMMARY

In one aspect, an underwater protective system for installation on the propeller of a boat is provided. The system is designed to inhibit marine growth on the propeller. The system includes a flexible material comprising first and second opposed panels having at least one common closed edge and at least one common one open edge, the panels sized and shaped so as to be capable of enclosing the front and rear surfaces of the blades of the propeller; a member (e.g., clamp, clip, snap, Velcro™, or other fastening device) for maintaining the flexible material in a state enclosing the propeller; and a link (such a piece of line, webbing or a wand) having first end and a second end, the first end attached to at least one of the member and the flexible material, the link having sufficient length such that when the flexible material is enclosed about the propeller and maintained in place with the member the second end of the link extends to a location proximate to the boat at or above the waterline of the boat (such as to the transom or deck of the boat, or to a dock against which the boat is tied) wherein the link can be retrieved by a user of the boat. The link and member are constructed and arranged wherein a tug on the link by the user releases the flexible material from the propeller permitting the retrieval of the link, the member and the flexible material as a unit from the propeller without the aid of a diver.

In another aspect, a kit is disclosed comprising a set of the underwater protective systems as recited above designed to fit different size propellers. For example, the kit may include a first portion in which the flexible material is relatively reduced surface area such that the material is designed to fit propellers having a diameter under 20 inches. A second portion of the kit includes flexible material of a larger surface area is designed to fit propellers having a diameter of at least 20 inches. A diver offers a service of fitting boats in a marina with the protective systems of this disclosure and will include in the kit a multitude of such underwater protective systems of different sizes to fit sailboats and smaller powerboats of various sizes and propeller diameters (e.g., 12 inch to 18 inch), pleasure power boats with larger size propellers (e.g., with propeller diameters from 16 to 36 inches), and larger commercial vessels (e.g., with propellers from 36 to say 50 inches in diameter). The diver (or customer/boat owner) may trim excess material from the flexible material to obtain a more customized fit of the protective material to the propeller, taking into consideration such factors as the number of blades to the propeller, and the diameter of the propeller.

In one configuration, the protective system is manufactured and sold as a unit comprising the flexible material, the member, and the link. Alternatively, the system is sold as the flexible material and the member along with instructions for the purchaser to obtain a suitable length of line or webbing and attach one end to the fastening member (or the flexible material) and lead the other end to a convenient location above the water line such as the transom, deck, or nearby slip.

BRIEF DESCRIPTION OF THE DRAWINGS

FIG. 1 also shows a protective cover for an underwater component (e.g., depth transducer) and a second link extending from the protective cover for the component to the cockpit.

DETAILED DESCRIPTION

The protective system of this disclosure is designed to prevent or inhibit marine growth from attaching to propellers of vessels. The protective system is particularly useful for propellers of inboard engines of marine vessels of all types, in which the propeller is both fixed and submerged substantially below the waterline of the vessel and therefore relatively inaccessible from above the water (e.g., from a dinghy, a dock or the transom of the vessel). It could also be used on inboard-outboard propellers or outboards that are not adapted to pivot out of the water.

The protective system includes a flexible material that is gathered about the propeller and maintained in place with a fastening member or other means (hereafter. "member"), such as a clamp, Velcro™, snaps, clip, a pin, a hook, a slip knot, a ring, or other suitable fastening device. In preferred embodiments the member is made from a plastic or other material which contains no metal. A link, e.g., length of light line, webbing or a rigid strut or wand such as a piece of wood, has one end which is attached to the fastening member and/or the flexible material and a second free end which is led to a position above the waterline of the vessel where it can be readily retrieved by the user of the boat. When. the user is ready to remove the protective system, they give a tug on the link and that action releases the flexible material from the propeller, allowing the member and flexible material to be removed as a unit from the propeller and retrieved for later re-use, cleaning or disposal.

The flexible material serves to inhibit marine growth in at least two ways. First, it provides a barrier preventing barnacle larvae from reaching the propeller. Secondly, it shades the propeller from the sun thereby inhibiting growth of grass or slime on the blades of the propeller. The flexible material need not be wrapped perfectly tightly about the propeller, and indeed a loose fitting of the flexible material about the propeller is sufficient and promotes easy and reliable release of the protective system by the user from a position above the waterline.

For most boats, the system of this disclosure is typically installed on the propeller by a diver (which could be the owner if they are willing to get wet or have suitable dive equipment). However, a diver is not needed to remove the protective system. It can be immediately removed from the convenient position of the deck or adjacent slip by simply pulling on the link.

The protective system will now be described with reference to the appended Figures, which show representative and non-limiting examples of how the protective system can be constructed and installed on a variety of vessels.

Figure 1:
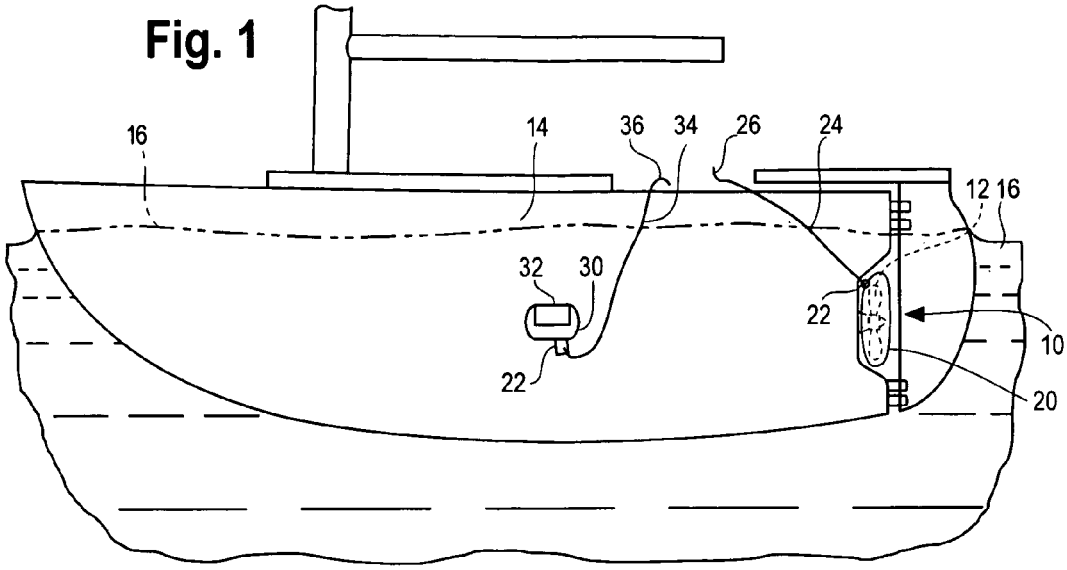
FIG. 1 is a schematic illustration of the protective system of this disclosure installed on the propeller of a boat having an inboard engine, submerged several feet below the waterline of the boat, with the link extending into the cockpit of the boat.

FIG. 1 is a schematic illustration of a protective system 10 installed on the propeller 12 of a boat 14 having an inboard engine (not shown), in which the propeller is submerged several feet below the waterline 16 of the boat 14. The protective system includes a flexible material 20 which is gathered around and about the front and rear surfaces of the propeller 12. A member, which in one preferred embodiment is a clamp 22 (see FIGS. 3-6) is attached or affixed to the flexible material 20 and clamps the material so that the material is maintained in the gathered condition so that the flexible material surrounds or covers the propeller. The member is preferably metal-free (e.g., made of a plastic or fiberglass material) so as to avoid corrosion in a salt water environment. A link 24 (e.g., line or webbing) has one end thereof 26 (FIGS. 3, 4) attached to the clamp 22 and a free second end 26. The link 24 is of sufficient length such that when the flexible material 20 is gathered about the propeller 12 and clamped with the fastening member (clamp 22), the free end 26 of the link 24 extends to a location proximate to the boat at or above the waterline of the boat wherein the link can be retrieved by a user of the boat, e.g., in the cockpit of the boat as shown in FIG. 1 or tied to a slip adjacent to the boat.

To remove the protective system, the user grasps the free end 26 of the link 24 and gives it a tug. This action releases the material 20 from the member 22 (or vice versa). By pulling in on the link 24 the user then retrieves the material 20 and member 22 as a unit from the propeller and brings it on deck for cleaning and stowage or disposal. This action is done by the user from the cockpit or the adjacent slip, without the user getting wet. No diver is required to remove the protective system 10.

In an embodiment in which the fastening member 22 is in the form of snaps or Velcro, for example, the invention works in a similar fashion. The fastening member is sufficient to hold the flexible material gathered around the propeller. The end of the link may be attached to the fastening member directly or indirectly, or alternatively it may be attached to the flexible material directly or indirectly. It may be attached to both the fastening member and the flexible material, for example as shown in FIGS. 11-15 and 18.

FIG. 1 also shows a second protective cover 30 for an underwater component (e.g., depth transducer 32) and a second link 34 extending from the protective cover 30 such that the free end 36 is in the cockpit, on deck or tied to an adjacent slip. This embodiment may optionally use an elastic band to retain the cover 30 on the fitting 32, or the cover may be secured by means of gathering the material forming the cover about the fitting and clamping it in place with a clamp, in which case the end of the link 34 is attached to the clamp. In either situation, the cover is removed by the user simply by tugging on the link 34 and pulling the cover into the cockpit for cleaning and stowage or for disposal.

Figure 2:
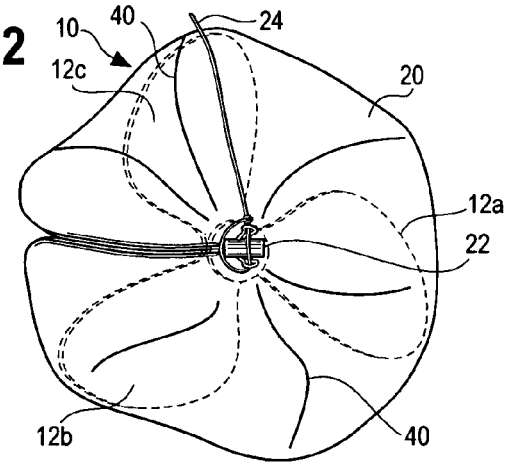
FIG. 2 is a detailed view of the flexible material of the protective system gathered about the propeller of FIG. 1, and clamped or otherwise held in place about the propeller with fastening member such as a clamp, clip or other device.

FIG. 2 is a more detailed view of the flexible material 20 of the protective system 10 gathered about the blades 12A, 12B and 12C of the propeller 12 of FIG. 1, and maintained in place with the clamp 22 or other suitable fastening member such as a clip or snaps. The manner or technique by which the material 20 is gathered about the blades of the propeller and maintained in place so that the material surrounds both the front and rear surfaces of the propeller is not critical. The material can be gathered on the side of the propeller proximate to the propeller shaft, outboard of the propeller (where a zinc anode would be typically placed for a boat immersed in salt water), proximate to one of the blades, or between the blades. The point of gathering can be on the "top" of the propeller (i.e., the point closest to the water surface), or to the side or even on the "bottom" of the propeller. In FIG. 2 the gathering is indicated by the folds or creases 40 in the material.

Figure 3:
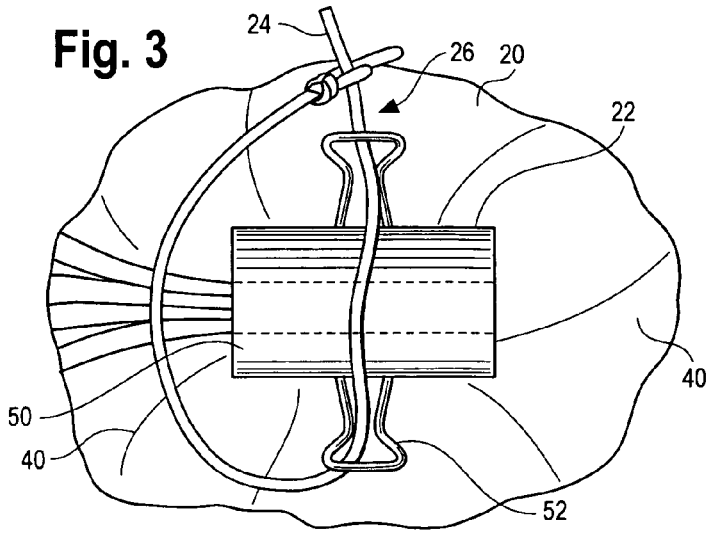
FIG. 3 is a further more detailed view of the clamp of FIG. 2 and the first end of the link extending through the level arms of the clamp.

FIG. 3 is a further more detailed view of the clamp 22 of FIG. 2 and the first end 26 of the link 24. In this embodiment, the clamp 22 takes the form of a C-shaped clamp (a clamp or clip of this type for paper is suitable) having a spring-like clamping element 50 and pairs of lever arms 52 attached to the clamping element 50 that are used to expand the C-shaped clamping element to allow the clamp to fasten to the gathered material, whereupon the lever arms are released. The end 26 of the link 24 is led through the lever arms 52 and tied in a knot (e.g., bowline). When the link 24 is pulled, this action pulls the clamp 22 off of the gathered material held by the clamp. The material 20 then can be pulled free from the propeller. Thus, hauling in the link 24 allows the clamp 22 and attached material 20 to be removed as a unit from the propeller and retrieved for cleaning and later re-use, or for disposal.

Suitable materials from the flexible material 20 include plastic sheeting, canvas, Sunbrella and other synthetic fabrics, as well as materials specifically adapted for receiving antifouling paints such as Hypalon (chlorosulfonated polyethylene synthetic rubber), Hypalon coated nylon, and PVC-coated nylon. In one embodiment, the flexible material is coated with antifouling paint.

Figure 4A:
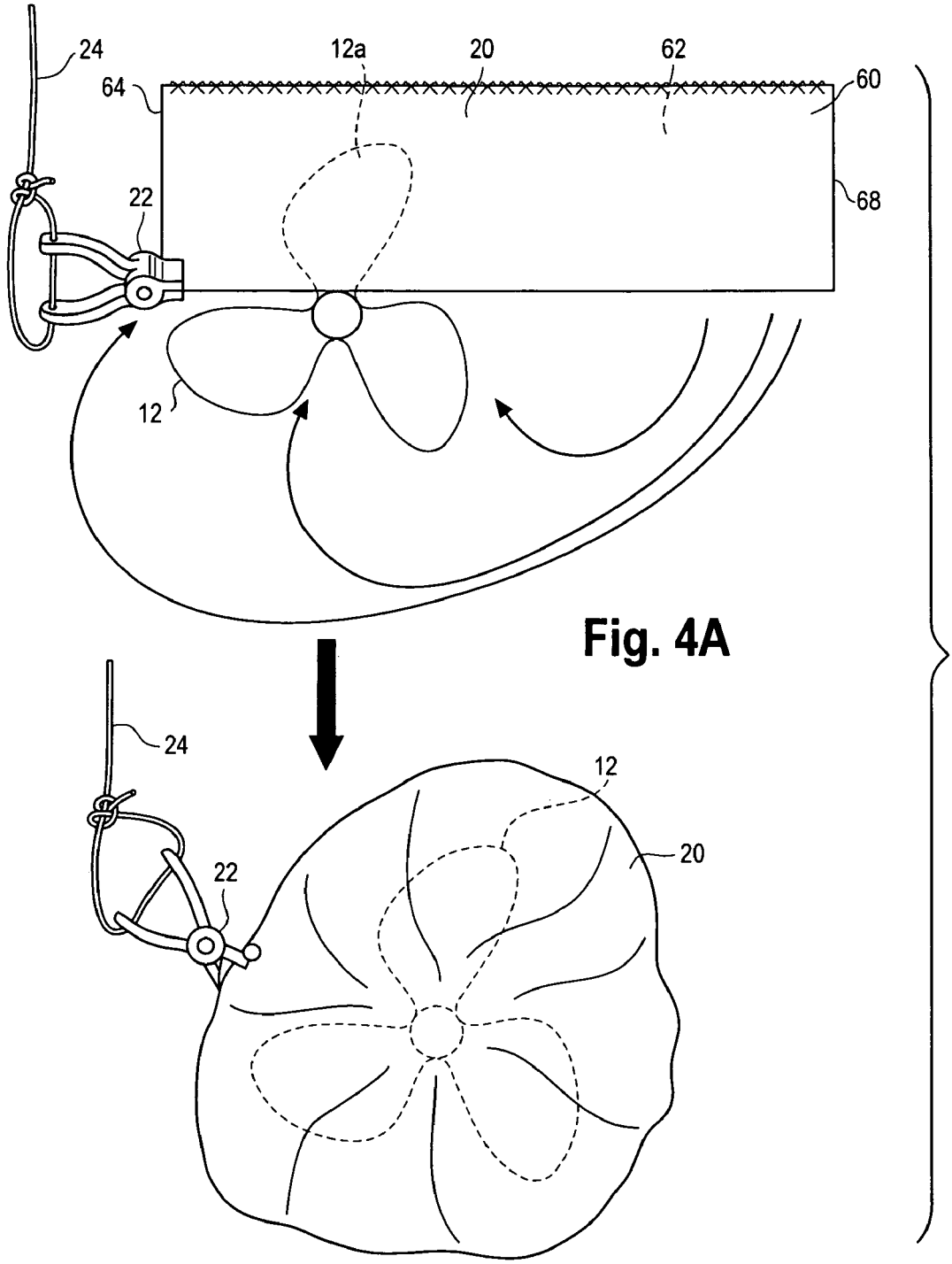
FIG. 4A shows the steps involved of installing the protective system of FIG. 4 on a propeller.
Figure 4:
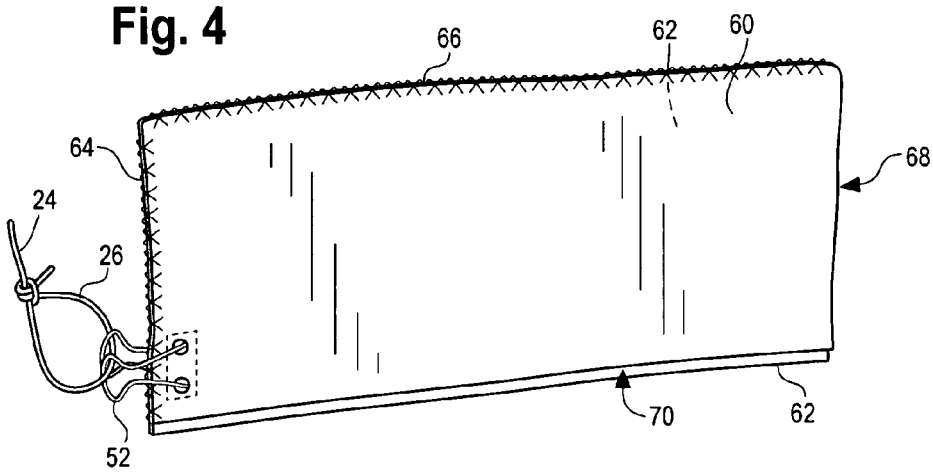
FIG. 4 is plan view of the protective system of FIGS. 1-3 prior to installation on the propeller, showing a clamp affixed to the flexible material and the link.
Figure 5:
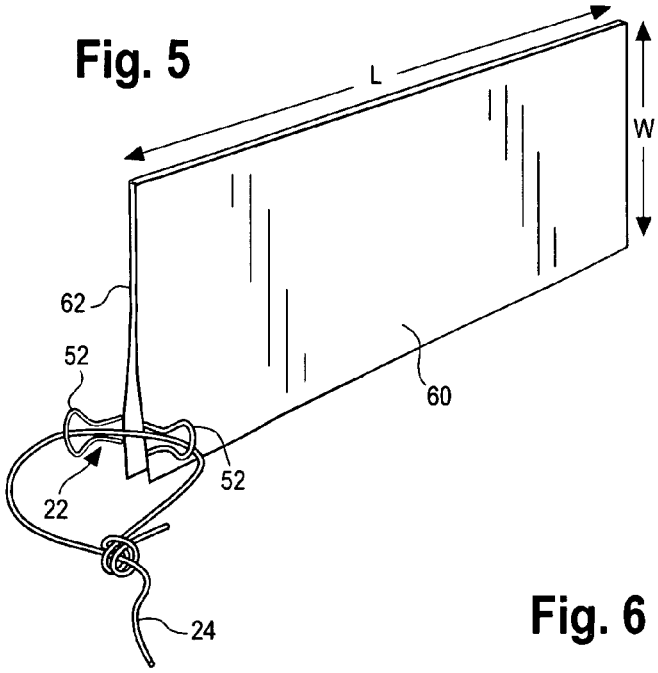
FIG. 5 is a perspective view of the protective system of FIG. 4.
Figure 6:
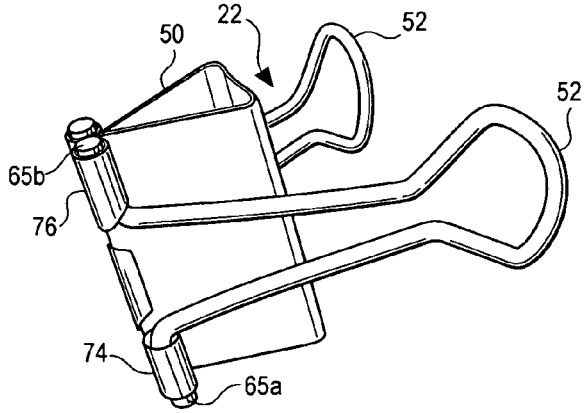
FIG. 6 is a more detailed view of one embodiment of the clamp of FIGS. 1-5.

FIG. 4 is a plan view of the protective system of FIGS. 1-3 prior to installation on the propeller of FIG. 1. FIG. 5 shows the system in a perspective view. The flexible material includes two rectangular panels 60 and 62 of approximately the same size, with two adjacent closed edges joined by a seam as indicated at 64 and 66 and having open sides 68 and 70, forming a quasi tent-like structure. At one corner of the material 20 a clamp 22 is attached to both panels 60 and 62. In the example of the paper clip-like C-clamp 22 as shown in FIG. 6, the clamp 22 is disassembled, four holes are made in the material (two on each panel 60 and 62) and then the free ends 65A and 65B of the lever arms are inserted into the holes and then assembled into the corresponding receiving structures 74 and 76 of the clamp 22. In this manner, the lever arms 52 protrude from the exterior surface of the material 20 but the clamping element is on the inside of the panels 60 and 62 as shown by dashed lines in FIG. 4. The end 26 of the link 24 is tied off to one, or more preferably both, of the lever arms 52 and the length of the link 24 trimmed so that it has sufficient length to extend from the propeller to a convenient position above the waterline, e.g., to the deck or cockpit of the boat or a slip adjacent to the boat.

While a paper-clip like clamp is shown in FIG. 3, plastic clamps with lever arms which operate on the same basic principle are known and commercially available and are also suitable.

The length L (FIG. 5) and the width W of the panels 60 and 62 will of course vary depending on the size of the propeller that the system is going to be installed on. For example, for a three-blade propeller of 16 inches in diameter the panels may have a length L of 30-40 inches and a width W of 12-16 inches.

It will be noted that while in the embodiment of FIG. 4 the two panels 60 and 62 are joined by seams 64 and 66, this is not essential, and a single rectangular panel of material can be folded in half length-wise and only seam 64 added to join one edge to form the structure of FIG. 4. Still other configuratiohs for the flexible material are possible, including oval or circular shapes. Continuous, bag-like shapes are less preferred since they would be difficult to remove without the aid of a diver. However, such shapes might be used if provisions are made for extraction of the material without difficulty, such as providing slits in the material, or gathering the material and clamping it at several locations, with each location being provided with an attached clamp 22 and associated retrieval link 24.

FIG. 4A shows the installation of the protective system on a propeller 12. The cover 20 is installed over one of the blades 12A so that the blade is placed within the two panels 60 and 62 as shown in the upper view. The user then essentially wraps or gathers the material 20 about the other two blades as indicated by the arrows so that they are placed within the panels 60 and 62 and the edge 68 is brought around to the edge 64 to thereby wrap up the propeller as shown in the lower view. The member 22 is then affixed to the material (typically where the edges 64 and 68 meet) to maintain the flexible material 20 in the gathered state. The member 22 is shown as a ratchet-type clamp in FIG. 4A. The free end of the link 24 is tied to one or both of the arms of the fastening member 22. The member is attached to the flexible material 20 in any suitable manner. When the user pulls the link 24, the jaws of the fastening member 22 release from the material 20 and allow the material 20, fastening member 22 and link 24 to be retrieved for later reuse, stowage or disposal.

Figure 7:
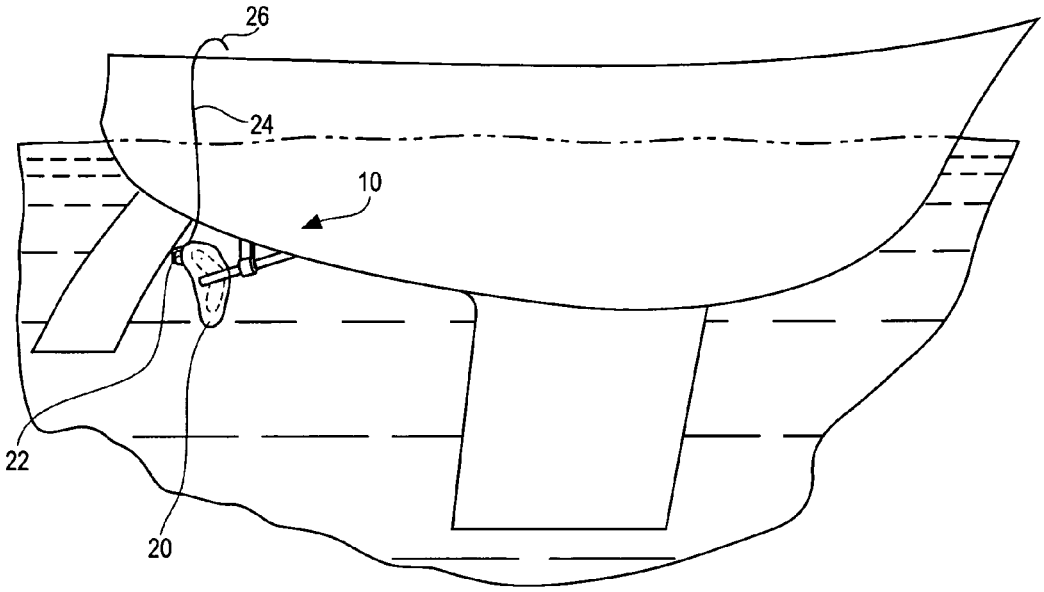
FIG. 7 is an illustration of the protective system of this disclosure installed on the propeller of a fin-keel type sail boat.
Figure 8:
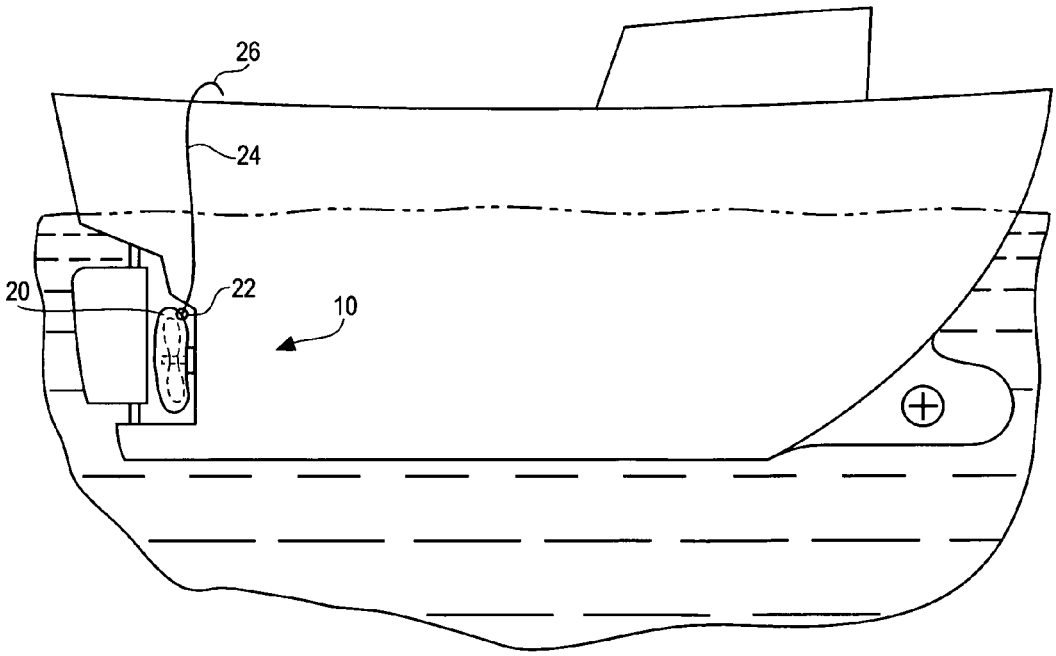
FIG. 8 is an illustration of the protective system of this disclosure installed on a propeller of a commercial fishing boat.

As noted above, the protective system of this disclosure is suitable for use with a variety of different configurations of propellers and different boats. FIG. 7 is an illustration of the protective system 10 of this disclosure installed on the propeller of a fin-keel type sail boat FIG. 8 is an illustration of the protective system of this disclosure installed on a propeller of a deep draft commercial fishing boat having a four bladed propeller five or six feet below the water line.

Figure 9A:
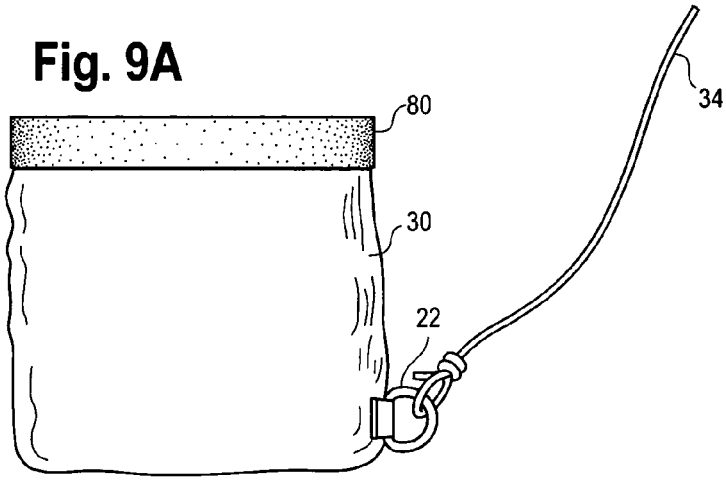
FIGS. 9A-9C are illustration of three embodiments of a protective system for an underwater component such as a depth transducer.
Figure 9B:
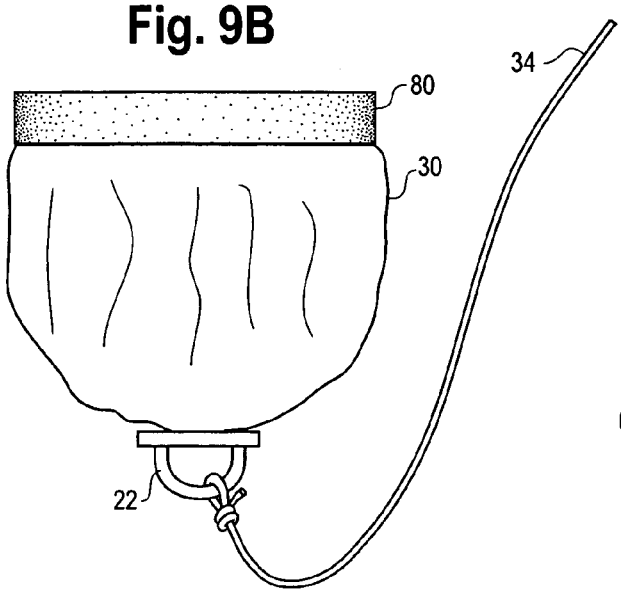
Figure 9C:
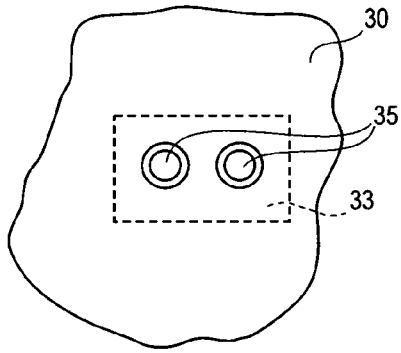
Figure 10:
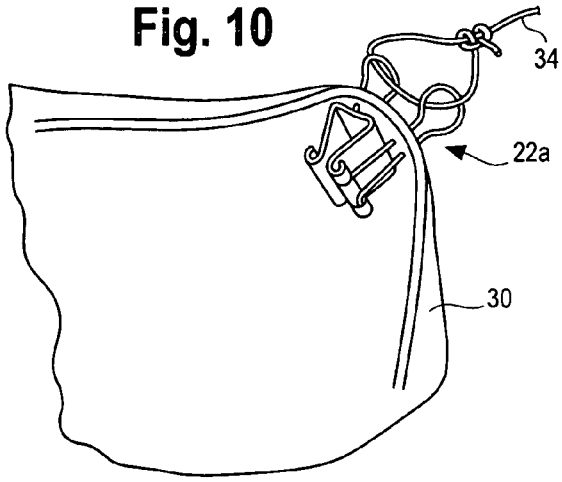
FIGS. 10 is an alternative configuration for a protective cover made from a flexible material adapted to protect underwater components such a depth transducers from marine growth.

FIG. 9A shows the protective cover for an underwater component such as a depth transducer in the form of a flexible material 30 (FIG. 1) in the form of a pouch or bag having an elastic band 80 about its rim to hold onto the component and prevent it from falling off. The link 34 (line or webbing) is lead to a position on the deck of the boat as shown in FIG. 1. The link has one end thereof fastened to a fastening member such as a ring 22. FIG. 9B shows an alternative embodiment with the ring 22 located in the middle of a bottom panel of the cover. FIG. 9C shows another embodiment in which the bottom panel includes a solid reinforcement 33 to prevent barnacle larvae from penetrating the cover and the fastening member is in the form of two holes/grommets 35 formed in the cover 30. The user leads the link through the holes 35 and ties off the end of the link in a knot. In FIG. 10, the cover 30 is in the form of a rectangular or irregular shaped material having a clamp 22A or other suitable fastening member attached to the material 30 (as described above for FIG. 4), and a line 34 tied off to the lever arms of the clamp and lead to a position on deck or in the cockpit. In the embodiments of FIGS. 9 and 10, the user tugs on the free end of the link 34 from the convenience of the deck or cockpit to remove the cover 30 from the underwater metal fitting. The link 34 is preferably tied to the bottom or corner of the cover 30 so that it will release when pulled from above.

While the link 24 is shown in the Figures as a length of line, it could also take the form of webbing or a rigid member, e.g., a wood, plastic or fiberglass wand. One end of the rigid member is tied or otherwise affixed to the clamp and the free end led or tied off at the transom or adjacent slip.

In one configuration, the protective system is manufactured and sold as a unit comprising the flexible material, attached clamping member, and the link. Alternatively, the system is sold as the flexible material 20 and the attached member 22 along with printed instructions for the purchaser to obtain a suitable length of line or webbing and attach one end to the member and/or flexible material 20 and lead the other end to a convenient location above the water line such as the transom, deck, or nearby slip.

Figure 11:
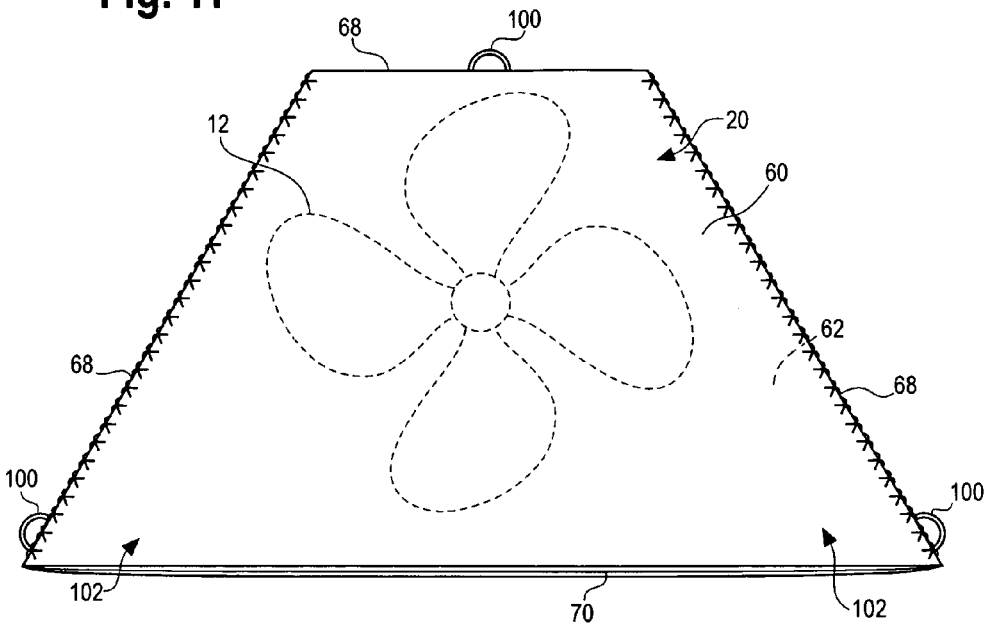
FIG. 11 is a plan view of an alternative configuration of the flexible material of FIGS. 1 and 2 with a blade propeller shown in dashed lines.

FIG. 11 is a plan view of an alternative configuration of the flexible material 20 of FIGS. 1 and 2 with a propeller 12 shown in dashed lines. The flexible material includes first and second opposed panels 60 and 62 having at least one common closed edge (three common closed edges 68 in this configuration) and at least one common open edge 70. The panels 60 and 62 are sized and shaped so as to be capable of enclosing the front and rear surfaces of the blades of the propeller 12. The flexible material includes attachment members 100 which can take the form of grommets, webbing sewn in the form of loops as shown, hooks, or other devices. The attachment members 100 serve as a feature for permitting the end of the link 24 to be attached to the flexible material, as shown in FIG. 12.

In use, the diver places the flexible material of FIG. 11 over the propeller as shown and folds the corner portions 102 towards the center of the open edge and clamps them together to enclose the propeller. The resulting configuration is shown in FIG. 12. The clamp 22 is attached directly to the link 24. The end 104 of the link is attached to the attachment feature 100 as shown in FIG. 12. The other end of the link 24 is led to a position at or above the waterline of the boat as explained above. To retrieve the protective system, the user tugs on the link 24. This action releases the clamp 22 from the flexible material. The link becomes taut with further pulling of the link 24 lifting the flexible material 20 off of the propeller and permitting retrieval of the link 24, flexible material 20 and member 22.

Figure 12:
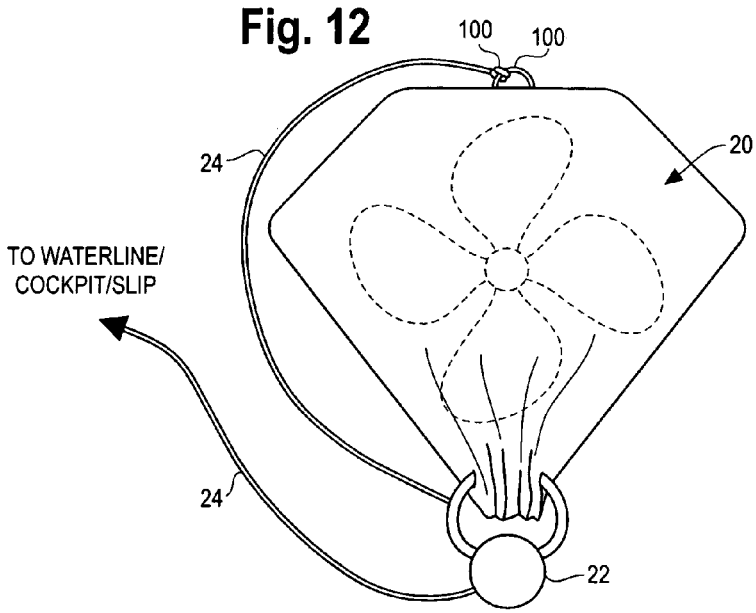
FIG. 12 is an illustration of the flexible material of FIG. 11 shown gathered about the propeller.
Figure 13:
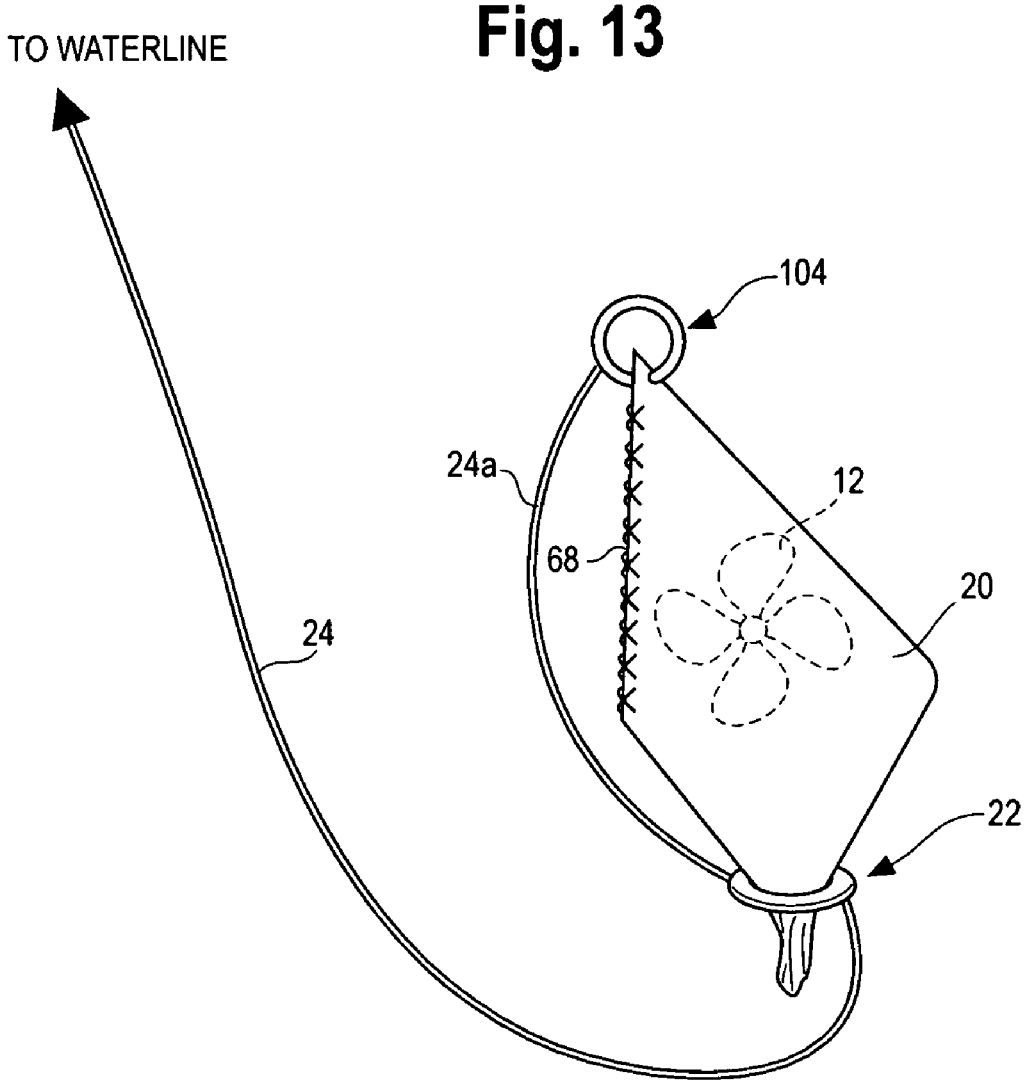
FIG. 13 is an illustration of the flexible material of FIG. 11 shown gathered about the propeller with an alternative mechanism of retaining the material in the gathered condition in the form of a ring.

FIG. 13 shows an alternative configuration to the configuration of FIG. 12, in which the member 22 is in the form of a ring which is attached to the link (e.g. by a light line). The user pulls on the link 24, which pulls the ring 22 off of the flexible material 20. This allows the flexible material to relax from its gathered state. A link extension 24A connects the ring 22 to a grommet 104 (attachment feature) at the top of the flexible material opposite from the open end. Further pulling of the link 24 causes the link 24 and link extension 24A to become taut and causes the flexible material 20 to lift off of the propeller and be retrieved.

Figure 14:
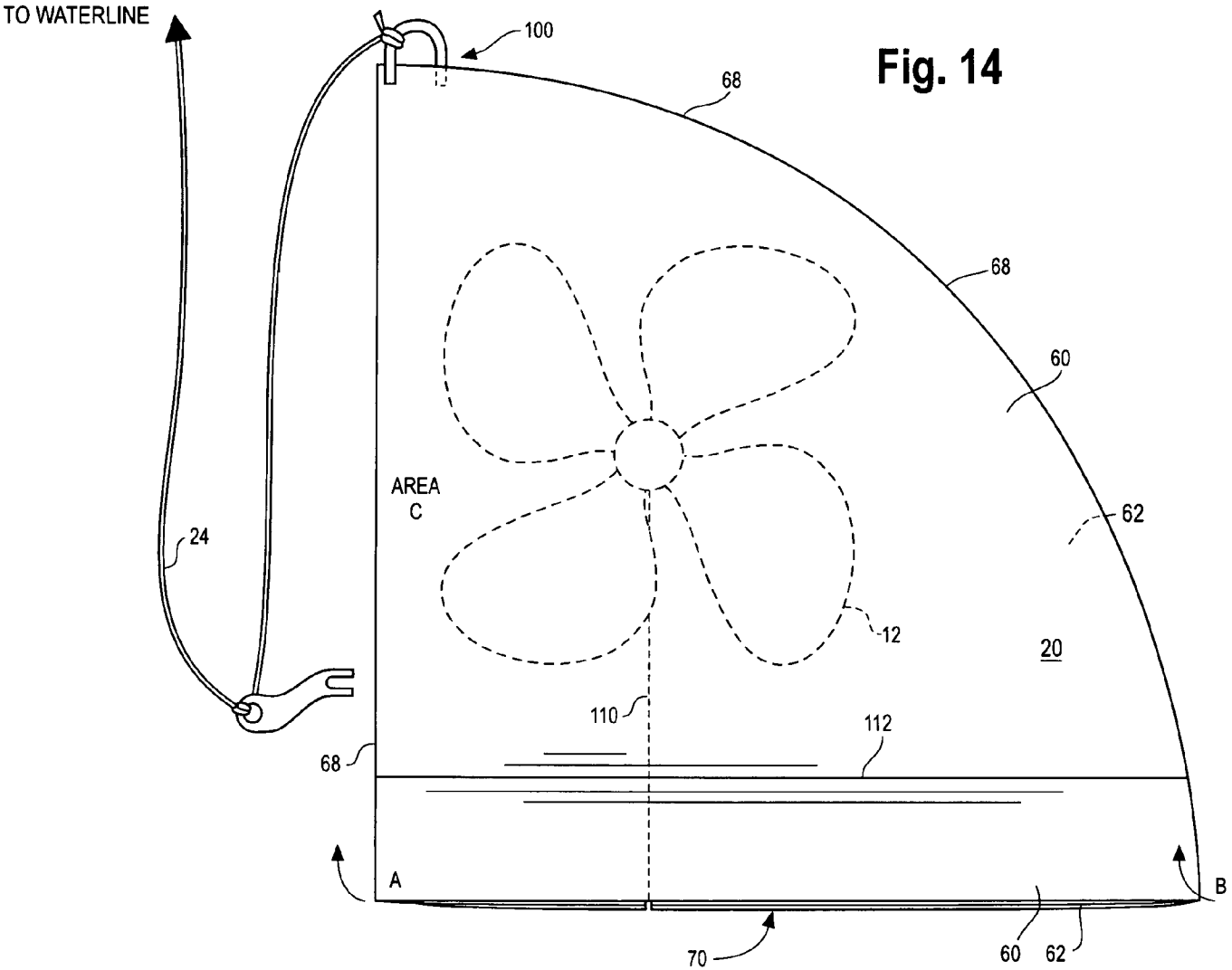
FIG. 14 is a plan view of a further alternative configuration of the protective system of FIGS. 1 and 2.

FIG. 14 is a plan view of a further alternative configuration of the protective system of FIGS. 1 and 2. The first and second opposed panels 60 and 62 have a generally triangular configuration with two common closed edges 68 and one open edge 70. A slit 110 is formed in one of the panels 60 and 62 which extends from the open edge 70 towards the center of the panel so as accommodate a shaft (not shown) for the propeller 12 when the system is installed. The link 24 includes a clamp 22 which is attached to the link and the end of the link is tied or otherwise attached to an attachment fitting 100 such as webbing, grommet or loop. To install the flexible material 20 on the propeller, the diver places open edge 70 of the flexible material 20 over the propeller with the slit 110 accommodating the prop shaft so that the material is in the condition shown in FIG. 14. Corners A and B and folded up along the fold line 112. Corner B is folded towards area C to enclose the propeller. The flexible material as gathered in area C is clamped or fastened in place with member 22 (e.g., clamp). The free end of the link 24 is secured to the cockpit or deck of the boat or to an adjacent slip. A tug on the link 24 unclamps the clamp 22 from the flexible material, allowing the flexible material to revert to the condition shown in FIG. 14, and a further pull on the link 24 pulls the flexible material from the propeller and the retrieval of the member 22, link 24 and flexible material 20 as a unit.

Figure 15:
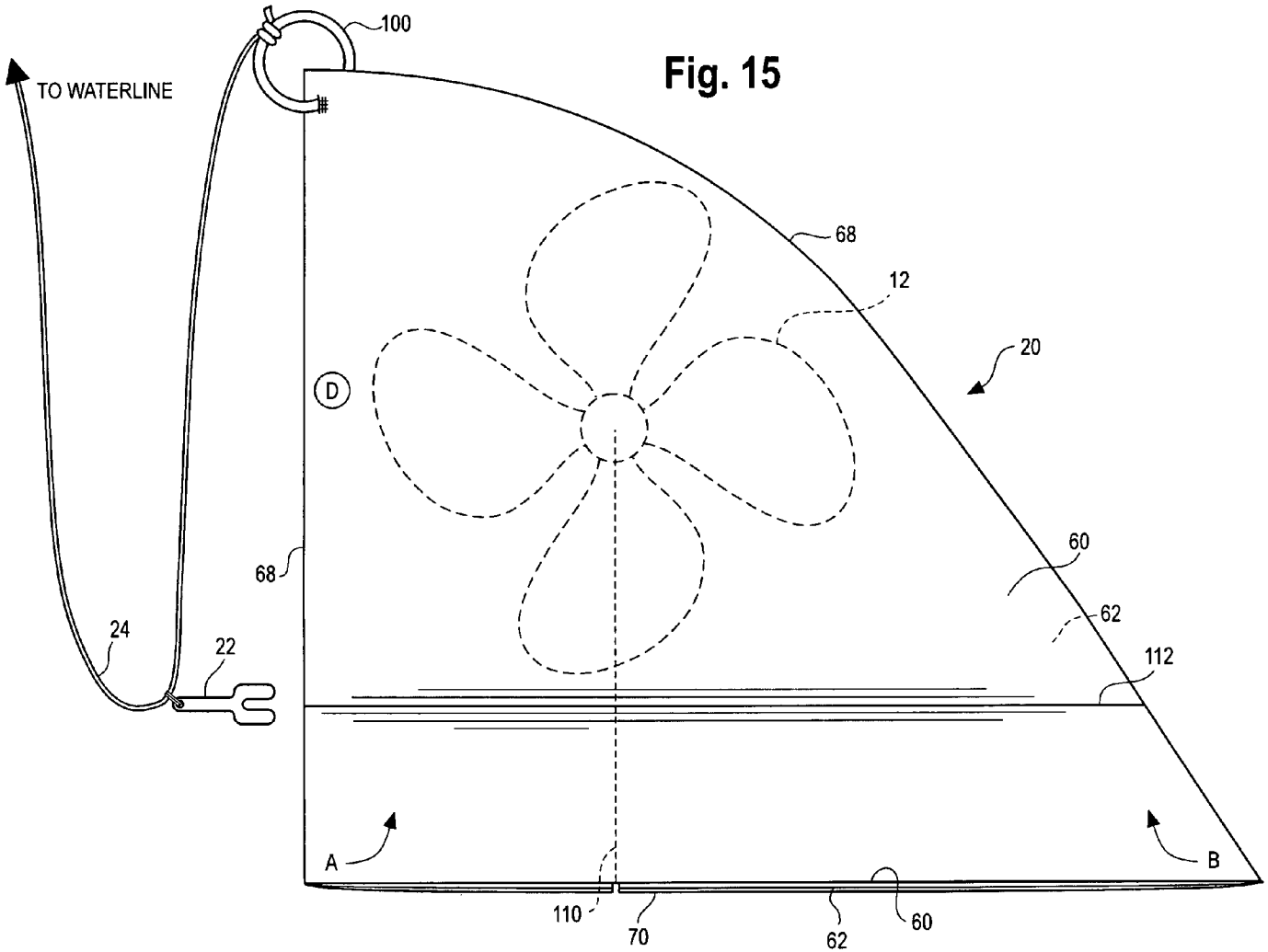
FIG. 15 is a plan view of a further alternative configuration of the protective system of FIGS. 1 and 2.

FIG. 15 is a plan view of a further alternative configuration of the protective system of FIGS. 1 and 2. The embodiment includes generally triangular opposed panels 60 and 62 with closed edges 68 and one open edge 70, and a slit 110 in one of the panels 60, 62 for the propeller shaft. The installation of the embodiment of FIG. 15 is as follows:

a. The flexible material 20 is placed over the propeller and shaft as described above resulting in the configuration shown in FIG. 15.

b. The bottom open edge 70 is folded up along the fold line 112 by grasping the corners A and B.

c. The corner B is brought over to area D.

d. The clamp 22 is clamped to the gathered material in area D.

e. The link 24 is connected to the deck or cockpit or to an adjacent slip at or above the waterline.

Figure 16:
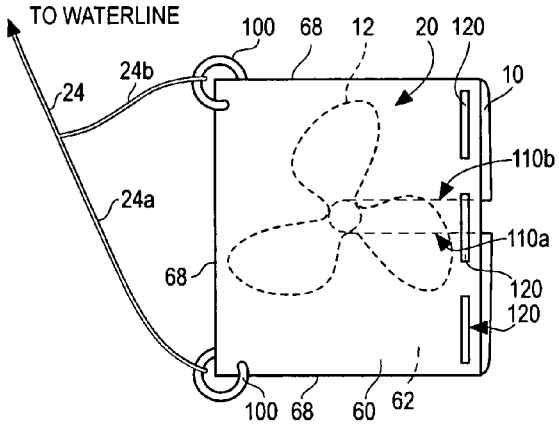
FIG. 16 is a plan view of a further alternative configuration of the protective system of FIGS. 1 and 2.

FIG. 16 is a plan view of a further alternative configuration of the protective system of FIGS. 1 and 2 with a propeller 12 shown in dashed lines. The panel 60 includes a slit 110A and the panel 62 includes a slit 110B. The slits are for accommodating the propeller shaft as the flexible material is moved laterally over the propeller to the configuration shown in FIG. 16. The flexible material maintains enclosure over the propeller by means of a member in the form of Velcro strips 120 placed in the inner surfaces of the panels 60 and 62. The link 24 includes link extensions 24A and 24B which are tied to attachment features 100 in the form of webbing loops. A pull on the link 24 releases the Velcro attachment of the panels and allows the link, flexible material and attached Velcro strips to be retrieved as a unit.

Figure 17:
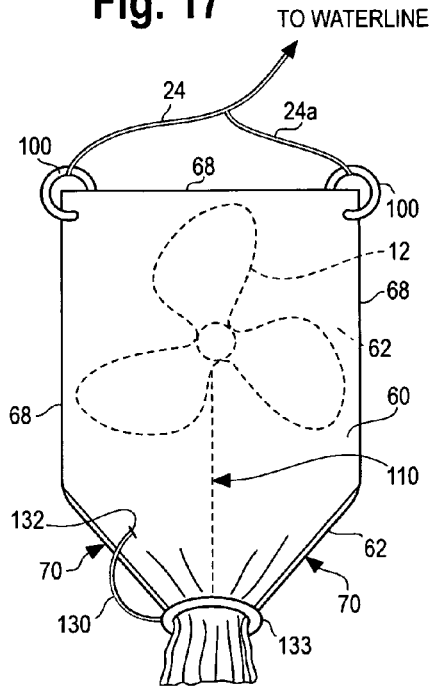
FIG. 17 is a plan view of a further alternative configuration of the protective system of FIGS. 1 and 2.

FIG. 17 is a plan view of a further alternative configuration of the protective system of FIGS. 1 and 2. The panels 60 and 62 have closed edges 68 and one open edge 70. The edge 70 is gathered and secured by member 33 in the form of a ring, which is attached to panel 60 by means of light line 130 at location 132. The end of link 24 is attached to the attachment features 100. When the user pulls on the link, the flexible material is pulled through the ring 33 and released from the gathered condition, permitting the retrieval of the link and flexible material (and the ring 33) as a unit.

Figure 18:
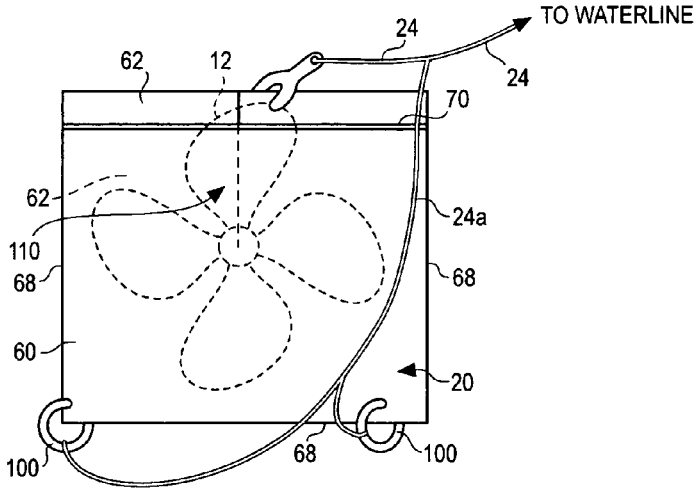
FIG. 18 is a plan view of a further alternative configuration of the protective system of FIGS. 1 and 2.

FIG. 18 is a plan view of a further alternative configuration of the protective system of FIGS. 1 and 2. In this configuration, the panels 60 and 62 form a quasi-pouch, with closed edges 68, one open edge 70, and a slit 110 for accommodating the propeller shaft. The open edge 70 of the flexible material is folded over the propeller blade 12A as shown. The link 24 is connected to both the fastening member 22 (e.g., clamp), and to the attachment features 100. When the user tugs on the link 24, the clamp 22 is released and the link extension 24A become taut, pulling the flexible material off of the propeller and permitting retrieval of the flexible material 20, member 22 and the link 24 as a unit.

The following clauses are offered as further descriptions of the disclosed invention.

1. A protective system for underwater installation on the propeller of a boat, the boat having a waterline, the propeller having blades with front and rear surfaces, comprising:

a flexible material (20) comprising first and second opposed panels (60 and 62) having at least one common closed edge (68) and at least one common open edge (70), the panels sized and shaped so as to be capable of enclosing the front and rear surfaces of the blades of the propeller;

a member (22) for maintaining the flexible material in a state enclosing the propeller; and a link (24) having first end and a second end, the first end attached to at least one of the member and the flexible material, the link having sufficient length such that when the flexible material is enclosed about the propeller and maintained in place with the member the second end of the link extends to a location proximate to the boat at or above the waterline of the boat wherein the link can be retrieved by a user of the boat;

wherein the link and member are constructed and arranged wherein a tug on the link by the user releases the flexible material from the propeller permitting the retrieval of the link, the member and the flexible material as a unit from the propeller without the aid of a diver.

2. The system of claim 1, wherein the flexible material further comprises an attachment feature (100) and wherein the link is connected to both the member and the attachment feature (e.g., FIGS. 14, 15, 18).

3. The system of claim 1, wherein the flexible material further comprises two or more attachment features and wherein the link is connected to the two or more attachment features (e.g., FIGS. 16-18).

4. The system of claim 1, wherein the first and second opposed panels have three common closed edges and one open edge (e.g., FIGS. 4, 11, 16, 17).

5. The system of claim 1, wherein the member is selected from the group consisting of a clamp and a ring.

6. The system of claim 1, wherein at least one of the two opposed panels further comprises a slit (110) extending from the open edge to accommodate a shaft for the propeller when the flexible material is installed on the propeller.

7. The system of claim 1, wherein the first and second panels have a generally triangular shaped form with three sides, two common closed edges and an open edge (FIGS. 14, 15).

8. The system of claim 7, further comprising a slit (110) in at least one of the two opposed panels extending from the open edge to accommodate a shaft for the propeller when the flexible material is installed on the propeller.

9. The system of claim 7, wherein the wherein the flexible material further comprises an attachment feature (100) and wherein the link is connected to both the member and the attachment feature (FIGS. 14, 15).

10. The system of claim 9, wherein the first end of the link is attached to the attachment feature, and wherein the member is attached to the link intermediate the first and second ends of the link (FIGS. 14, 15).

11. The system of claim 10, wherein the member comprises a clamp.

12. The system of claim 4, wherein the first and second opposed panels each comprise a slit (110) extending from the open edge to accommodate a shaft for the propeller when the flexible material is installed on the propeller (FIG. 16);

wherein the flexible material comprises first and second attachment features (100) for connecting to the first end of the link.

13. The system of claim 1, wherein the member comprises a ring which is fastened to the flexible material, wherein the flexible material further comprises an attachment feature, and wherein the first end of the link is attached to the attachment feature (FIG. 17).

14. The system of claim 1, wherein the link comprises a flexible line or webbing and wherein the flexible line is of sufficient length to extend from the flexible material to a position on the deck of the boat.

15. The system of claim 1, wherein the flexible material comprises a material specifically designed and suited for application of antifouling paint.

16. A kit comprising a set of the underwater protective systems as recited in claim 1 designed to fit different size propellers.

17. A protective system for underwater installation on the propeller of a boat, the boat having a waterline, the propeller having blades with front and rear surfaces, comprising:

a flexible material comprising first and second opposed panels having at least one common open edge and at least one common closed edge, the panels sized and shaped so as to be capable of enclosing the front and rear surfaces of the blades of the propeller;

a member for maintaining the flexible material in a state enclosing the propeller; and instructions for a user to attach one end of a link to at least one of the fastening member and the flexible material, the link having sufficient length such that when the flexible material is gathered about the propeller and maintained in place with the fastening member, the link extends to a location proximate to the boat at or above the waterline of the boat wherein the link can be retrieved by a user of the boat whereby a tug on the link by the user releases the flexible material from the propeller permitting the retrieval of the link, and the attached fastening member and the flexible material as a unit from the propeller without the aid of a diver.

Various modifications to the illustrated embodiments may be made without departure from the spirit and scope of the invention. This true scope and spirit is to be arrived at by reference to the appended claims, interpreted in light of the foregoing specification.

I claim:

1. A protective system for underwater installation on the propeller of a boat, the boat having a waterline, the propeller having blades with front and rear surfaces, comprising:

a flexible material comprising first and second opposed panels, the panels sized and shaped so as to be capable of enclosing the front and rear surfaces of the blades of the propeller;

hook and loop fastener affixed to the flexible material in a manner for maintaining the flexible material in a state enclosing the propeller; and a link having first end and a second end, the first end attached to the flexible material, the link having sufficient length such that when the flexible material is enclosed about the propeller and maintained in place by the hook and loop fastener the second end of the link extends to a location proximate to the boat at or above the waterline of the boat wherein the link can be retrieved by a user of the boat;

wherein a tug on the link by the user releases hook and loop fastener and thereby the flexible material from the propeller permitting the retrieval of the link and the flexible material as a unit from the propeller without the aid of a diver.

2. The system of claim 1, wherein the flexible material further comprises a slit in at least one of the first and second opposed panels for accommodation of a propeller shaft connected to the propeller when the flexible material is installed on the propeller.

3. The system of claim 1 wherein the first and second opposed panels have two common closed edges.

4. The system of claim 1, wherein the first and second panels have a generally rectangular shaped form with two common closed edges and at least one open edge.

5. The system of claim 1, wherein the first and second panels have a generally triangular form with two common closed edges and one open edge.

6. The system of claim 1, further comprising a ring which is connected to the flexible material, wherein the first end of the link is attached to the ring.

7. The system of claim 1, wherein the link comprises a flexible line or webbing and wherein the flexible line is of sufficient length to extend from the flexible material to a position on the deck of the boat.

8. The system of claim 1, wherein the flexible material comprises a material specifically designed and suited for application of antifouling paint.

9. A kit comprising a set of the underwater protective systems as recited in claim 1 designed to fit different size propellers.

10. A protective system for underwater installation on the propeller of a boat, the boat having a waterline, the propeller having blades with front and rear surfaces, comprising:

a flexible material comprising first and second opposed panels having at least one common open edge and at least one common closed edge, the panels sized and shaped so as to be capable of enclosing the front and rear surfaces of the blades of the propeller;

hook and loop fastener affixed to the flexible material in a manner for maintaining the flexible material in a state enclosing the propeller; and instructions for a user to attach one end of a link to the flexible material, the link having sufficient length such that when the flexible material is gathered about the propeller and maintained in place with the fastening member, the link extends to a location proximate to the boat at or above the waterline of the boat wherein the link can be retrieved by a user of the boat whereby a tug on the link by the user releases the hook and loop fastener and the flexible material from the propeller permitting the retrieval of the link and the flexible material as a unit from the propeller without the aid of a diver.

11. A method of protecting a fixed propeller of an inboard engine of a boat from fouling by marine growth, the boat having a waterline, the propeller submerged several feet or more below the waterline of the boat and thereby generally inaccessible to a user of the boat from a position on a transom of the boat, a dinghy or an adjacent dock, the propeller having blades with front and rear surfaces, comprising the steps of:

(1) with a diver, (a) enclosing the propeller in a flexible material, the panels sized and shaped so as to be capable of enclosing the front and rear surfaces of the blades of the propeller; and (b) securing the flexible material in a state enclosing the propeller by joining hook and loop fastener affixed to the flexible material, the enclosing of the propeller in the flexible material inhibiting marine growth on the propeller, (2) providing the flexible material with a link having first end attached to the flexible material and a free second end and leading the free second end of the link to a location proximate to the boat at or above the waterline of the boat wherein the link can be retrieved by a user of the boat; and (3) subsequently, tugging on the link to release the flexible material from the propeller and retrieving the link and the flexible material as a unit from the propeller without the aid of a diver thereby exposing the propeller in a state substantially free of marine growth.

12. The method of claim 11, wherein the flexible material further comprises a slit in at least one of the first and second opposed panels for accommodation of a propeller shaft connected to the propeller when the flexible material is installed on the propeller.

13. The method of claim 11, wherein the first and second opposed panels have two common closed edges.

14. The method of claim 11, wherein the first and second panels have a generally rectangular shaped form with two common closed edges and at least one open edge.

15. The method of claim 11, wherein the first and second panels have a generally triangular form with two common closed edges and one open edge.

16. The method of claim 11, further comprising a ring which is connected to the flexible material, wherein the first end of the link is attached to the ring.

17. The method of claim 11, wherein the link comprises a flexible line or webbing and wherein the flexible line is of sufficient length to extend from the flexible material to a position on the deck of the boat.

18. The method of claim 11, wherein the flexible material comprises a material specifically designed and suited for application of antifouling paint.

19. The method of claim 11, wherein the boat comprises a sailboat having a fixed keel.

20. The method of claim 11, wherein the boat comprises a powerboat having a fixed keel.

21. A method of inhibiting marine growth on a propeller of a boat, the boat having a waterline, the propeller having two or more blades each having front and rear surfaces, comprising:

while the boat is in water, wrapping a flexible material around the front and rear surfaces of the blades of the propeller and gathering the material so that the material substantially surrounds the propeller;

maintaining the flexible material in the gathered state with the aid of a member;

leading a link having one end attached to at least one of the member and the flexible material to a location at or above the waterline of the boat wherein the link can be retrieved by a user of the boat;

wherein the link, flexible material and member are constructed and arranged wherein a tug on the link by the user releases the gathered flexible material from the propeller permitting the retrieval of the link, the member and attached flexible material as a unit from the propeller without the aid of a diver, wherein the wrapping, maintaining and leading steps are performed by a diver; and wherein the member comprises hook and loop fastener.

* * * * *